US005976061A

United States Patent [19]

Moon et al.

[11] Patent Number: 5,976,061

[45] Date of Patent: Nov. 2, 1999

[54] TREADMILL HAVING VARIABLE RUNNING SURFACE SUSPENSION

[75] Inventors: Daniel R. Moon, Riverview, Ill.; David Green, St. Charles; Stanley J. Goldfader, St. Louis, both of Mo.

[73] Assignee: True Fitness Technology, Inc., O'Fallon, Mo.

[21] Appl. No.: 09/062,261

[22] Filed: Apr. 17, 1998

[51] Int. Cl.[6] ..... A63B 22/02

[52] U.S. Cl. ..... 482/54

[58] Field of Search ..... 482/51, 54

[56] References Cited

U.S. PATENT DOCUMENTS

| | | | |
|---|---|---|---|
| 3,689,066 | 9/1972 | Hagen . | |
| 4,886,266 | 12/1989 | Trulaske | 482/54 |
| 4,984,810 | 1/1991 | Stearns et al. . | |
| 5,072,928 | 12/1991 | Stearns et al. . | |
| 5,184,988 | 2/1993 | Dunham . | |
| 5,279,528 | 1/1994 | Dalebout et al. . | |
| 5,336,144 | 8/1994 | Rodden . | |
| 5,382,207 | 1/1995 | Showronski et al. . | |
| 5,441,468 | 8/1995 | Deckers et al. | 482/54 |
| 5,484,362 | 1/1996 | Showronski et al. . | |
| 5,542,892 | 8/1996 | Buhler | 482/54 |
| 5,599,259 | 2/1997 | Showronski et al. . | |
| 5,626,539 | 5/1997 | Piaget et al. . | |
| 5,649,882 | 7/1997 | Parikh et al. . | |

*Primary Examiner*—Glenn E. Richman

*Attorney, Agent, or Firm*—Howell & Haferkamp, LC

[57] ABSTRACT

A treadmill of the present invention comprises a base, a pair of spaced rollers journalled in the base, an endless belt, a longitudinally extending support deck, and a deck spacer. One of the rollers constitutes a rear roller and the other roller constitutes a forward roller spaced forward of the rear roller. The endless belt is entrained around the rollers and includes an upper reach that extends longitudinally between the rollers. The upper reach of the belt is adapted to enable a user to walk or run thereon. The support deck is connected to the base and is operatively engageable with an underside of the upper reach of the endless belt for supporting the upper reach. The deck spacer includes a deck engaging portion adapted for operatively engaging the support deck. The deck engaging portion is adapted to operate in at least a first condition and a second condition. The deck spacer is adapted to provide a first resistance to downward movement of the deck relative to the base when the deck engaging portion is in the first condition, and to provide a second resistance to downward movement of the deck relative to the base when the deck engaging portion is in the second condition. The second resistance is different than the first resistance. The deck spacer includes a linearly moveable member that is linearly moveable relative to the base. The linearly moveable member is adapted for varying the deck engaging portion between its first and second conditions. In another aspect of the present invention, the deck spacer includes a rotatable member that is rotatably moveable relative to the base. The rotatable member is adapted for varying the deck engaging portion between its first and second conditions.

27 Claims, 3 Drawing Sheets

TREADMILL HAVING VARIABLE RUNNING SURFACE SUSPENSION

BACKGROUND OF THE INVENTION

This invention relates generally to exercise treadmills and, more particularly, to treadmills having an endless belt which is entrained around a pair of spaced rollers, and which has an upper reach on which a user can walk or run.

Typically, exercise treadmills include a continuous or endless belt which is entrained about a pair of spaced rollers. The belt has an upper reach which extends over a support deck which engages an underside of the upper reach for supporting a user while walking or running on the upper reach of the belt. The support deck and rollers are typically secured to a base or frame with one of the rollers near a front end of the treadmill and the other of the rollers near a rear end of the treadmill.

A problem with some prior art treadmills is that the belt supporting structure or support deck is too rigid and unyielding. While a certain amount of deck rigidity is necessary for the belt supporting structure to properly support the user while he or she walks or runs on the treadmill, rigid and unyielding support decks may be uncomfortable for the user and can be potentially damaging to the joints and tendons of the user, especially when the treadmill is used over long periods of time. These problems have been addressed in some prior art treadmills which incorporate shock absorption means that provide a softer walking or running surface.

Another problem with many prior art treadmills is that the degree of resiliency or shock absorption of the support deck is generally a constant that does not necessarily suit all users nor all uses of the treadmill. Different levels of "energy return" (springiness or resiliency) and/or impact cushioning may be desirable during walking or running, as well as for other reasons such as medical rehabilitation. Also, the same treadmill is often shared by multiple users that may have vastly different weights and exercise abilities. Thus, there is a need for a treadmill belt supporting structure that permits the user or users to selectively adjust the degree of resiliency or "energy return" of the support deck, as well as the degree of impact cushioning or shock absorption.

SUMMARY OF THE INVENTION

It is an object of the present invention to provide a treadmill which permits the user to selectively adjust the amount of resiliency or "energy return" provided by the treadmill. Another object is to provide a treadmill which permits a user to adjust the support deck suspension to effect various levels of resiliency and impact cushioning. Still another object is to provide a treadmill having an adjustable deck spacing mechanism which can be adjusted by the user while running or walking on the treadmill to selectively vary the amount that the deck flexes in response to the user's foot step impact.

In general, a treadmill of the present invention comprises a base, a pair of spaced rollers journalled in the base, an endless belt, a longitudinally extending support deck, and a deck spacer. One of the rollers constitutes a rear roller and the other roller constitutes a forward roller spaced forward of the rear roller. The endless belt is entrained around the rollers and includes an upper reach that extends longitudinally between the rollers. The upper reach of the belt is adapted to enable a user to walk or run thereon. The support deck is connected to the base and is operatively engageable with an underside of the upper reach of the endless belt for supporting the upper reach. The deck spacer includes a deck engaging portion adapted for operatively engaging the support deck. The deck engaging portion is adapted to operate in at least a first condition and a second condition. The deck spacer is adapted to provide a first resistance to downward movement of the deck relative to the base when the deck engaging portion is in the first condition, and to provide a second resistance to downward movement of the deck relative to the base when the deck engaging portion is in the second condition. The second resistance is different than the first resistance. The deck spacer includes a linearly moveable member that is linearly moveable relative to the base. The linearly moveable member is adapted for varying the deck engaging portion between its first and second conditions.

In another aspect of the present invention, a treadmill comprises a base, a pair of spaced rollers journalled in the base, an endless belt, a longitudinally extending support deck, and a deck spacer substantially as described above. However, the deck spacer includes a rotatable member that is rotatably moveable relative to the base. The rotatable member is adapted for varying the deck engaging portion between its first and second conditions.

In yet another aspect of the present invention, a treadmill comprises a base, a pair of spaced rollers journalled in the base, an endless belt, and a longitudinally extending support deck substantially as described above. The treadmill also comprises a spacer mechanism. The spacer mechanism is operatively engageable with the support deck in a manner for applying an upwardly directed bracing force against the support deck to resist downward movement of the deck relative to the base. The spacer mechanism is adapted to vary the position of the upwardly directed bracing force longitudinally relative to the deck to selectively apply the bracing force to different portions of the deck along a longitudinal extent of the deck.

In still another aspect of the present invention, a treadmill comprises a base, a pair of spaced rollers journalled in the base, an endless belt, and a longitudinally extending support deck substantially as described above. The treadmill also includes a deck spacer operatively engageable with the support deck, and a drive mechanism for driving the deck spacer. The deck spacer is operatively engageable with the support deck in a manner for resisting downward movement of the deck relative to the base. The drive mechanism is adapted for longitudinally moving the deck spacer relative to the deck between forward and rearward positions.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
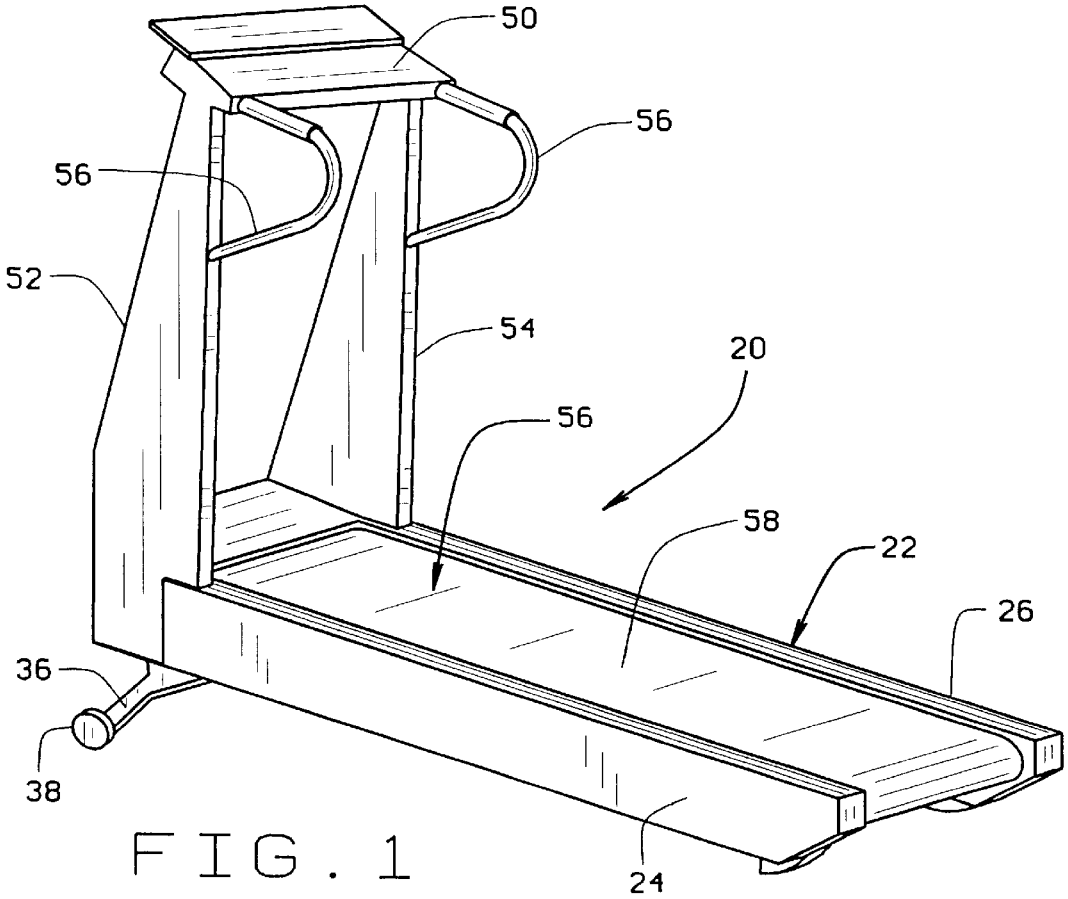
FIG. 1 is a perspective view a treadmill of the present invention.
Figure 3:
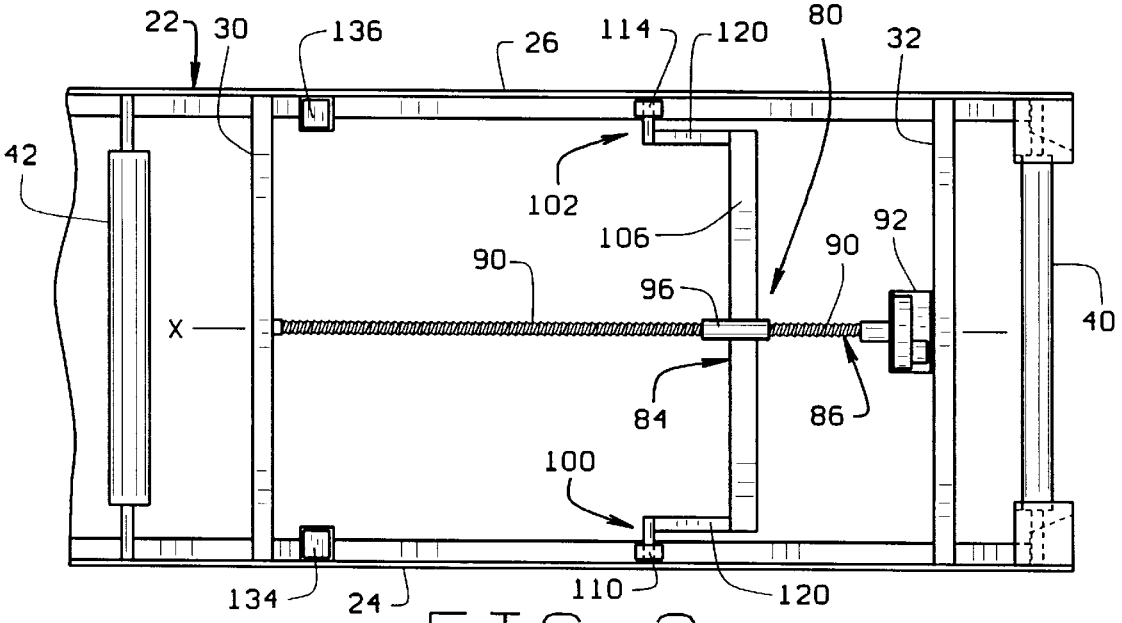
FIG. 3 is a fragmented top plan view of the treadmill of FIG. 1 with the belt and support deck removed to show detail of the deck spacer mechanism and drive mechanism.

A treadmill of the present invention is represented in its entirety in FIG. 1 by the reference numeral 20. Preferably, the treadmill 20 includes a base 22 having a left side rail 24 and a right side rail 26. The left and right side rails 24 and 26 are spaced laterally from one another and are preferably substantially parallel with one another. As best shown in FIG. 3, the base 22 includes a forward transverse support member 30 interconnected between the left and right side rails 24 and 26. A rear transverse support member 32 is similarly interconnected between the left and right side rails 24 and 26. The base 22 may also include leg support structures 36 (shown in FIG. 1) at the forward end of the base 22. Each such leg support structure 36 may include a wheel 38 at its distal end. The leg support structures 36 may be movable toward or away from the base 22 to adjust the angle of inclination of the treadmill 20.

The treadmill includes a rear roller 40 and a forward roller 42 spaced forward of the rear roller 40. The rear and forward rollers 40 and 42 extend transversely across the base 22 and are journalled in the left and right side rails 24 and 26 of the base 22 for rotation relative thereto. Preferably, at least one of the rollers is a drive roller which is driven by a suitable power drive mechanism (not shown). The power drive mechanism may include, for example, a variable speed motor operatively connected to the drive roller by a drive train, such as a belt and pulley system. Various types of drive mechanisms and drive trains could be employed without departing from the scope of the present invention.

As shown in FIG. 1, a control console 50 is supported above the base 22 by left and right console support members 52 and 54. Handles 56 are mounted to the support members 52 and 54 and extend rearwardly therefrom. The control console 50 preferably includes controls (not shown) that may be operated by the user to operate the treadmill 20 while walking or running. The controls may permit the user to adjust the speed of the treadmill 20, the angle of inclination, the degree of difficulty of the exercises, and other parameters, some of which are described below.

Figure 4:
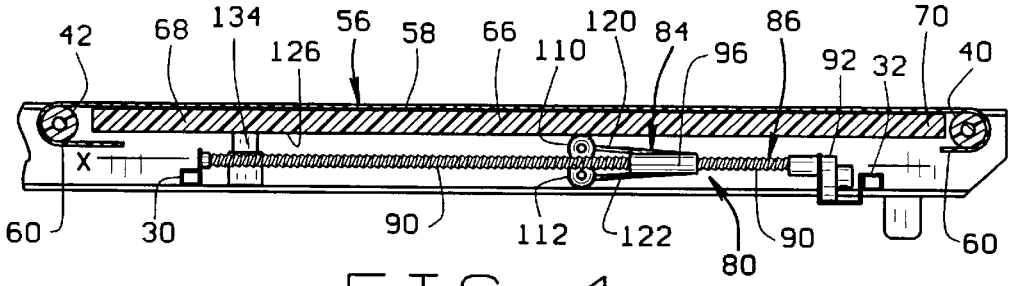
FIG. 4 is a fragmented, cross-sectional view of the treadmill of FIG. 1 taken along the plane of line 4—4 in FIG. 1 showing the deck spacer mechanism in a rearward position.
Figure 5:
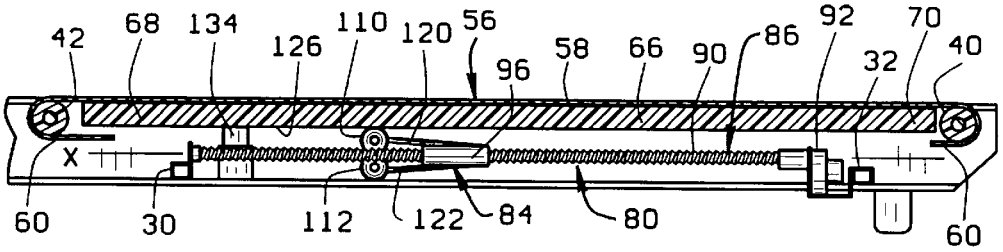
FIG. 5 is a fragmented, cross-sectional view of the treadmill similar to that of FIG. 4, but showing the deck spacer mechanism in a forward position.

The treadmill 20 includes a continuous or endless belt 56 which is entrained around the rear and forward rollers 40 and 42. The belt 56 includes an upper reach 58 extending longitudinally between the rollers 40 and 42. As shown in FIG. 1, the belt 56 also extends laterally across the treadmill 20 substantially from the left side rail 24 to the right side rail 26. A lower reach 60 of the belt 56 is shown in FIGS. 4 and 5, but is partially cut away in FIGS. 4 and 5 to show detail of a spacer mechanism, which is described in detail below. The belt 56 is adapted so that a user can run or walk on the upper reach 58 of the belt 56.

The treadmill 20 includes a longitudinally extending support deck 66 connected to the base 22. The support deck 66 is operatively engageable with an underside of the upper reach 58 of the belt 56 for supporting the upper reach 58. Thus, the user can run or walk on top of the upper reach 58 of the belt 56 with the weight of the user being supported by the support deck 66. The support deck 66 has a forward end 68 generally adjacent the forward roller 42 and a rearward end 70 generally adjacent the rear roller 40. Preferably, the rearward end 70 of the support deck 66 is fixed relative to the base 22 so that the support deck 66 is generally secured relative to the base 22 in a cantilever manner with the forward end 68 of the support deck 66 being movable downwardly relative to the base 22.

Figure 8:
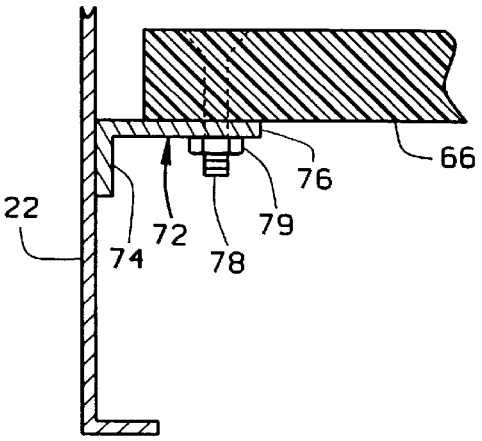
FIG. 8 is a fragmented, cross-sectional end view taken along the plane of line 8—8 in FIG. 2 showing detail of a cantilevered connection of a rearward end of the support deck to the base of the treadmill.

As shown in FIG. 8, the rearward end of the support deck 66 is preferably fixedly connected to the base 22 by a flange 72. The flange 72 includes a first leg 74 and a second leg 76. Preferably, the first leg 74 of the flange 72 is fixedly connected to the base 22, such as spot welding (not shown), and the second leg 76 is connected to the base by mechanical fasteners, such as internally threaded nuts 79 and externally threaded bolts 78. As shown in FIG. 8, the bolts 78 are preferably countersunk in the deck 66 so as not to interfere with movement of the belt 56 over the upper surface of the deck 66. It should be understood that the first leg 74 of the flange 72 could be connected to the base 22 with mechanical fasteners or in other ways, or could be integrally formed with the base 22, while still serving the function of supporting the rearward end 70 of the deck 66 in a cantilever manner. Likewise, the second leg 76 of the flange 72 could be connected to the deck 66 in other ways without departing from the scope of the present invention. Preferably, a second flange (not shown) similar to the flange 72 shown in FIG. 8 is used on the opposite side of the support deck.

In the preferred embodiment of the present invention, the support deck is made of standard medium density fiberboard that meets American National Standards Institute (ANSI) specifications for such fiberboard. It has been found that medium density fiberboard bonds well with veneers and laminates. Preferably, a high-pressure laminate (not shown) is bonded to the upper surface of the support deck 66 to provide a low-friction interface between the belt 56 and the deck 66. However, the deck 66 could be made of other materials having similar flexural characteristics, and could be used with or without veneers or laminates, without departing from the scope of the present invention.

As shown in FIGS. 3–5, a deck spacer mechanism 80 is operatively engageable with the support deck 66 in a manner for applying an upwardly directed bracing force against the support deck 66 to resist downward movement of the deck 66 relative to the base 22. As will be explained in detail below, the deck spacer mechanism 80 is adapted to vary the position of the upwardly directed bracing force longitudinally relative to the support deck 66 to selectively apply the bracing force to different portions of the deck 66 along a longitudinal extent thereof.

The deck spacer mechanism 80 comprises a deck spacer 84 and a drive mechanism 86. The deck spacer 84 is operatively engageable with the support deck 66 in a manner for resisting downward movement of the deck 66 relative to the base 22. The drive mechanism 86 is adapted for longitudinally moving the deck spacer 84 relative to the deck 66 between a generally forward position (shown in FIG. 5) and a generally rearward position (shown in FIG. 4). When the deck spacer 84 is in the rearward position, the support deck 66, and particularly the forward end 68 of the support deck, is permitted to move or flex downwardly relative to the base 22 in response to the foot step impacts of the user. The rigidity of the walking or running surface is a function of the position of the deck spacer 84 along the longitudinal extent of the deck 66. When the deck spacer 84 is in the forward position, it provides greater resistance to the downward movement of the forward end 68 of the support deck 66 which results in a more rigid walking or running surface. Similarly, the amount that the deck 66 is permitted to flex downwardly in response to the user's foot step impact increases as the deck spacer 84 is moved rearwardly relative to the deck 66.

Preferably, the spacer mechanism 80 includes a suitable control mechanism (not shown), operable by the user from the control console 50 for controlling the drive mechanism 86. Thus, the deck spacer mechanism 80 is adapted to facilitate selective variation of the longitudinal position of the upwardly directed force relative to the deck 66, for adjusting the resiliency of the support deck 66 as well as the amount of foot step impact absorption, even while a user is walking or running on the upper reach 58 of the belt 56.

As shown in FIGS. 3–5, the drive mechanism 86 includes a drive screw 90 and a drive motor 92 for turning the screw 90 about its axis X. Operation of the motor 92 is preferably controlled by the user from the control console 50. Preferably, the drive screw 90 extends longitudinally between the forward transverse support member 30 and the rear transverse support member 32 and is journalled for rotation relative to the forward and rear transverse support members 30 and 32. As shown in FIGS. 3–5, the drive screw 90 is externally threaded. The deck spacer 84 includes an internally threaded sleeve portion 96 that is configured for threading engagement with the drive screw 90. The drive screw 90 and sleeve portion 96 are adapted so that turning of the screw 90 in one direction moves the deck spacer 84 toward the forward position, and turning of the screw 90 in an opposite direction moves the deck spacer 84 toward the rearward position.

The deck spacer 84 includes a first pair of wheels 100 and a second pair of wheels 102. The first and second pairs of wheels 100 and 102 are mounted to, and spaced laterally from one another by, a laterally extending bar 106. The first pair of wheels 100 includes a first upper wheel 110 and a first lower wheel 112 counter-rotatable about spaced parallel axes. Similarly, the second pair of wheels 102 includes a second upper wheel 114 and a second lower wheel (not shown) counter-rotatable about spaced parallel axes. As shown in FIG. 3, preferably, the first upper wheel 110 is rotatable about the same axis as the second upper wheel 114, and the first lower wheel 112 is rotatable about the same axis as the second lower wheel.

In the preferred embodiment of the present invention shown in FIGS. 3–5, the first upper wheel 110 and the second upper wheel 114 are connected to the laterally extending bar 106 by forwardly extending upper arm members 120. Similarly, the first lower wheel 112 and the second lower wheel are connected to the laterally extending bar 106 by forwardly extending lower arm members 122. However, the wheels could be connected to the deck spacer 84 in other ways without departing from the scope of the present invention as hereinafter claimed. For example, the wheels could be connected to the bar 106 by rearwardly extending arm members, or could be connected directly to the bar 106.

The first lower wheel 112 and the second lower wheel (not shown) are engageable with the base 22 and are adapted to roll against the base 22 as the deck spacer 84 is moved between its forward and rearward positions. The first upper wheel 110 and the second upper wheel 114 are engageable with a lower surface 126 of the support deck 66, and are adapted to roll against the lower surface 126 of the support deck 66 as the deck spacer 84 is moved between the forward and rearward positions.

The first upper wheel 110 is operatively engageable with the first lower wheel 112 in a manner such that rotation of the first upper wheel 110 in a first direction causes rotation of the first lower wheel 112 in a second direction opposite the first direction as the deck spacer 84 is moved between the forward and rearward positions. The second upper wheel 114 and the second lower wheel (not shown) are operatively engageable with one another in a similar manner.

Figure 2:
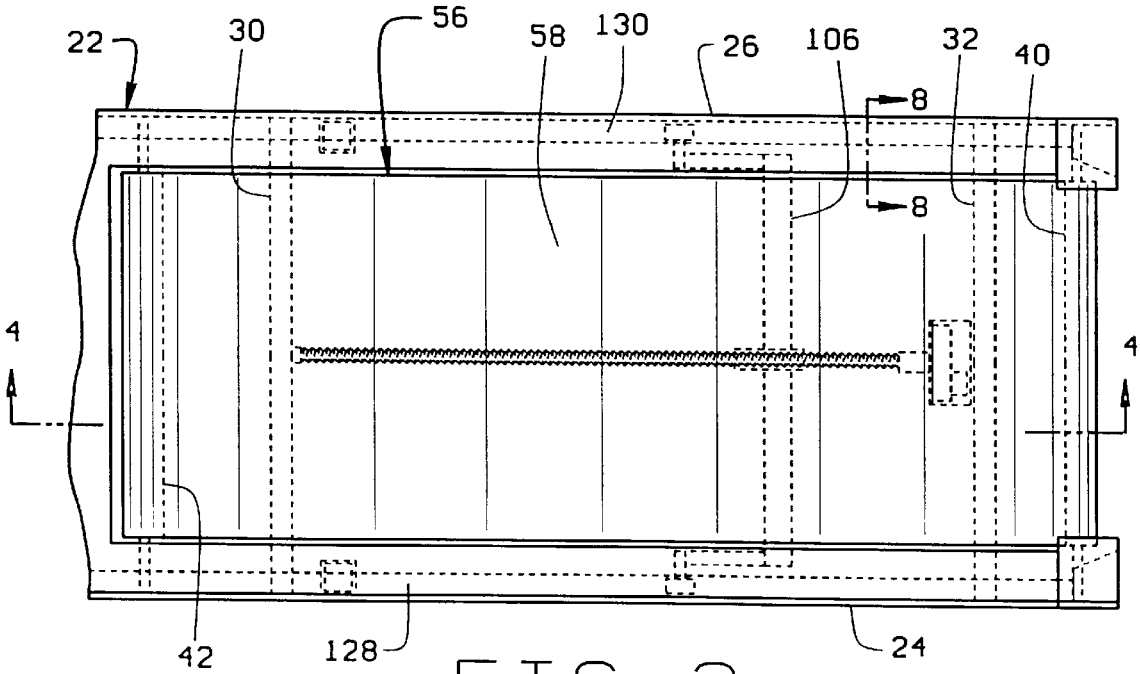
FIG. 2 is a fragmented top plan view of the treadmill of FIG. 1.

As shown in FIG. 2, the support deck 66 includes first and second opposite side edge margins 128 and 130. Preferably, the first upper wheel 110 rolls against the first side edge margin 128 and the second upper wheel 114 rolls against the second side edge margin 130 as the deck spacer 84 is moved between the forward and rearward positions. The first and second pairs of wheels 100 and 102 are spaced laterally from one another by the bar 106 and roll along the first and second side edge margins 128 and 130 to provide sufficient space therebetween for the lower reach 60 of the belt.

In the preferred embodiment of the present invention, the wheels are made of a high durometer polymeric material having a low degree of compressibility. In an alternative embodiment, however, the wheels are made of a lower durometer material that is more compressible. For example, in an alterative embodiment, the wheels could be made of an elastomeric material having a durometer of about 70 Shore A. Thus, in addition to providing a "fulcrum" that engages the support deck 66 for resisting downward movement of the deck 66 relative to the base 22, an alternative embodiment of the invention having compressible elastomeric wheels would also serve the function of providing an additional degree of impact cushioning and "energy return."

As best shown in FIGS. 3–5, the base 22 preferably includes first and second resilient members 134 and 136 mounted on the base 22 and positioned adjacent the first and second side edge margins 128 and 130 of the support deck 66. Preferably, the resilient members 134 and 136 are positioned near the forward end 68 of the support deck 66 beyond the forward-most reach of the deck spacer 84 so as not to interfere with forward travel of the deck spacer 84. Although the rearward end 70 of the support deck 66 is generally fixed relative to the base 22 so that the support deck 66 is cantileverly secured relative to the base, the resilient members 134 and 136 dampen the movement of the forward end 68 of the support deck 66. In one embodiment, the resilient members 134 and 136 are elastomeric members which may comprise a foam material or a low durometer (e.g., about 40 Shore A) neoprene. However, other materials could be used without departing from the scope of the present invention. Although selective movement of the deck spacer 84 will have the greatest effect on the resiliency and shock absorption characteristics of the support deck 66, the resiliency of the members 134 and 136 can also be selected to best suit the treadmill user and the type of use (e.g., walking, running, rehabilitation). Alternatively, the resilient members 134 and 136 could comprise coil, leaf or other types of springs, or could comprise fluid filled bladders. The resilient members 134 and 136 may take any of a variety of forms which serve the function of providing support for the forward end 68 of the support deck 66, while permitting the forward end 68 to move or flex downwardly in response to the foot step impact of the user.

Although the drive mechanism 86 has been described herein as being a motorized drive mechanism, it is to be understood that manually operated drive mechanisms may be employed without departing from the scope of this invention. For example, the screw could be replaced with a screw configured to be turned manually to move the deck spacer between its forward and rearward positions. Alternatively, the drive mechanism could comprise a track upon which the deck spacer travels, and a lever attached to deck spacer to manually push or pull the deck spacer along the track.

Figure 6:
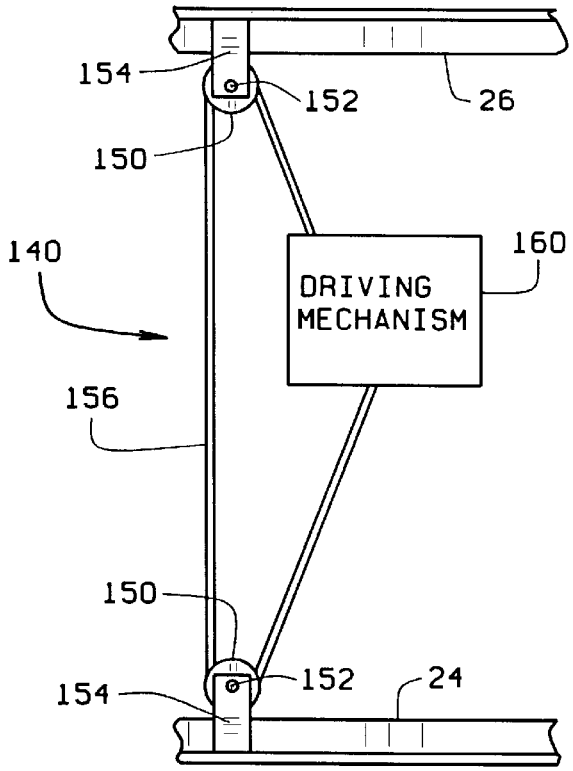
FIG. 6 is a fragmented, cross-sectional end view of a treadmill of the present invention showing an alternative embodiment of a deck spacer mechanism.

In an alternative embodiment of the present invention shown in FIG. 6, a treadmill includes a deck spacing mechanism 140 comprising an adjustable height bumper 142 (constituting a deck portion) moveable between a down position (shown in solid lines in FIG. 6) and an up position (shown in phantom lines in FIG. 6) relative to the support deck 66 along an axis Y. The deck spacing mechanism 140 includes an externally threaded drive screw 144 and an internally threaded nut member 146 fixed relative to the base 22. The drive screw 144 and nut member 146 are adapted for threading engagement with one another so that rotation of the drive screw 144 relative to the base 22 moves the drive screw 144 linearly along the Y axis. The bumper 142 is connected to an upper portion of the drive screw 144 so that linear movement of the drive screw 144 along the Y axis also results in linear movement of the bumper 142 along the Y axis.

Figure 7:
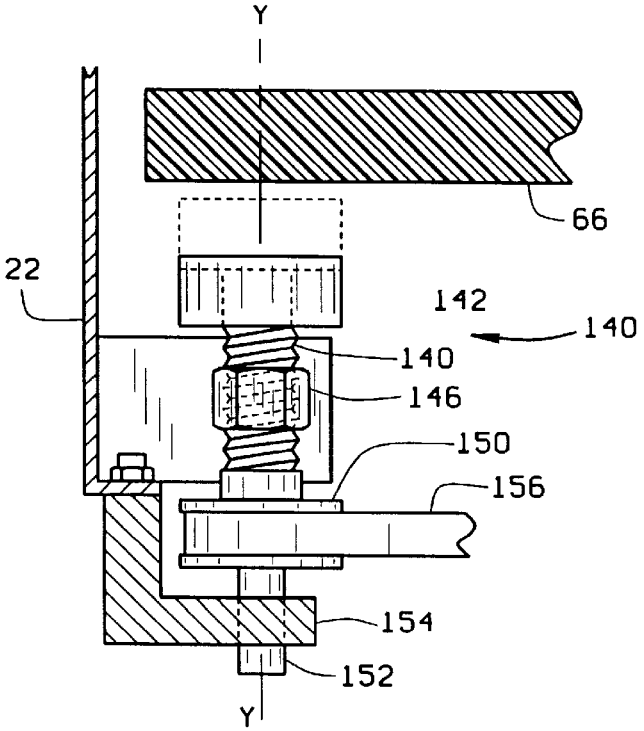
FIG. 7 is schematic representation of the deck spacer mechanism shown in FIG. 6 with an associated driving mechanism.

The deck spacing mechanism 140 also includes a pulley 150 rotatable relative to the base 22 on a shaft 152. The shaft 152 is journalled in a mounting member 154 which is secured to the base 22. A drive belt 156 is entrained around the pulley 150 for driving the pulley. The pulley 150 is fixed relative to the drive screw 144 for rotation together therewith. Thus, movement of the belt 156 causes rotation of the pulley 150 and drive screw 144 which, in turn, results in linear movement of the bumper 142 along the Y axis. FIG. 7 is a schematic representation of the deck spacer mechanism 140 shown with a suitable driving mechanism 160. The driving mechanism 160 is operatively engageable with the drive belt 156 for driving the belt relative to the base 22. Preferably, the driving mechanism 160 is operable by the user from the control console 50.

Although this embodiment of the present invention has been described with reference to a drive screw 144 that is adapted for movement relative to the base 22 for adjusting the level of resistance to downward movement of the support deck 66 relative to the base, other rotatable members or linearly moveable members may be employed in lieu of the drive screw 144 described above. For example, the deck spacer mechanism 140 may include a rotatable cam mechanism (not shown) adapted for varying the position of the bumper 142 relative to the support deck 66. Moreover, the deck spacer mechanism may include an adjustable spring having a variable spring constant which is varied via, for example, a motor driven adjustment screw. Still other mechanisms could be employed for adjusting the level of resistance to downward movement of the support deck 66 relative to the base 22 without departing from the scope of the present invention.

In view of the above, it will be seen that the several objects of the invention are achieved and other advantageous results attained.

As various changes could be made without departing from the scope of the invention, it is intended that all matter contained in the above description or shown in the accompanying drawings shall be interpreted as illustrative and not in a limiting sense.

What is claimed is:

1. A treadmill comprising:

a base;

a pair of spaced rollers journalled in the base, one of the rollers constituting a rear roller and the other roller constituting a forward roller spaced forward of the rear roller;

an endless belt entrained around the rollers, the endless belt including an upper reach extending longitudinally between the rollers and adapted to enable a user to walk or run thereon;

a longitudinally extending support deck connected to the base, the support deck being operatively engageable with an underside of the upper reach of the endless belt for supporting the upper reach;

a deck spacer including a deck engaging portion adapted for operatively engaging the support deck, the deck engaging portion being adapted to operate in at least a first condition and a second condition, the deck spacer being adapted to provide a first resistance to downward movement of the deck relative to the base when the deck engaging portion is in the first condition and to provide a second resistance to downward movement of the deck relative to the base when the deck engaging portion is in the second condition, the second resistance being different than the first resistance, the deck spacer including a linearly moveable member linearly moveable relative to the base, the linearly moveable member being adapted for varying the deck engaging portion between its first and second conditions.

2. A treadmill as set forth in claim 1 wherein said linearly moveable member comprises a drive screw, the drive screw being adapted so that turning of the screw varies the deck engaging portion between its first and second conditions.

3. A treadmill as set forth in claim 1 wherein a rearward portion of the support deck is fixed relative to the base so that the support deck is cantileverly secured relative to the base.

4. A treadmill comprising:

a base;

a pair of spaced rollers journalled in the base, one of the rollers constituting a rear roller and the other roller constituting a forward roller spaced forward of the rear roller;

an endless belt entrained around the rollers, the endless belt including an upper reach extending longitudinally between the rollers and adapted to enable a user to walk or run thereon;

a longitudinally extending support deck connected to the base, the support deck being operatively engageable with an underside of the upper reach of the endless belt for supporting the upper reach;

a spacer mechanism operatively engageable with the support deck in a manner for applying an upwardly directed bracing force against the support deck to resist downward movement of the deck relative to the base, the spacer mechanism being adapted to vary longitudinally the position of the upwardly directed bracing force relative to the deck to selectively apply the bracing force to different portions of the deck along a longitudinal extent of the deck.

5. A treadmill as set forth in claim 4 wherein the spacer mechanism is adapted to facilitate selective variation of the longitudinal position of the upwardly directed force relative to the deck even while a user is walking or running on the upper reach of the endless belt.

6. A treadmill as set forth in claim 4 wherein the spacer mechanism comprises:

a deck spacer operatively engageable with the support deck in a manner for resisting downward movement of the deck relative to the base; and a drive mechanism adapted for facilitating longitudinal movement of the deck spacer relative to the deck between forward and rearward positions.

7. A treadmill as set forth in claim 6 wherein the spacer mechanism further comprises a controller for controlling the drive mechanism.

8. A treadmill as set forth in claim 6 wherein the drive mechanism includes a drive screw, the drive screw being adapted so that turning of the screw in one direction moves the deck spacer toward the forward position and turning of the screw in an opposite direction moves the deck spacer toward the rearward position.

9. A treadmill as set forth in claim 6 wherein the deck spacer comprises a pair of wheels, the pair of wheels including an upper wheel and a lower wheel rotatable about spaced parallel axes, the lower wheel being engageable with the base and adapted to roll against the base as the spacer is moved between its forward and rearward positions, the upper wheel being engageable with a surface of the support deck and adapted to roll against the support deck as the spacer is moved between the forward and rearward positions.

10. A treadmill as set forth in claim 9 wherein the upper wheel is operatively engageable with the lower wheel in a manner such that rotation of the upper wheel in a first direction causes rotation of the lower wheel in a second direction opposite the first direction as the spacer is moved between the forward and rearward positions.

11. A treadmill as set forth in claim 9 wherein the pair of wheels constitutes a first pair of wheels, the upper wheel constitutes a first upper wheel, and the lower wheel constitutes a first lower wheel, and wherein the deck spacer further comprises a second pair of wheels, the second pair of wheels including a second upper wheel and a second lower wheel rotatable about spaced parallel axes, the second lower wheel being engageable with the base and adapted to roll against the base as the spacer is moved between its forward and rearward positions, the second upper wheel being engageable with a surface of the support deck and adapted to roll against the support deck as the spacer is moved between the forward and rearward positions.

12. A treadmill as set forth in claim 11 wherein the support deck includes first and second opposite side edge margins, the first upper wheel being adapted to roll against the first side edge margin as the spacer is moved between the forward and rearward positions, the second upper wheel being adapted to roll against the second side edge margin as the spacer is moved between the forward and rearward positions.

13. A treadmill as set forth in claim 4 wherein a rearward portion of the support deck is fixed relative to the base so that the support deck is cantileverly secured relative to the base.

14. A treadmill comprising:

a base;

a pair of spaced rollers journalled in the base, one of the rollers constituting a rear roller and the other roller constituting a forward roller spaced forward of the rear roller;

an endless belt entrained around the rollers, the endless belt including an upper reach extending longitudinally between the rollers and adapted to enable a user to walk or run thereon;

a longitudinally extending support deck connected to the base, the support deck being operatively engageable with an underside of the upper reach of the endless belt for supporting the upper reach;

a deck spacer operatively engageable with the support deck in a manner for resisting downward movement of the deck relative to the base; and a drive mechanism adapted for facilitating longitudinal movement of the deck spacer relative to the deck between forward and rearward positions.

15. A treadmill as set forth in claim 14 wherein the deck spacer comprises a pair of wheels, the pair of wheels including an upper wheel and a lower wheel rotatable about spaced parallel axes, the lower wheel being engageable with the base and adapted to roll against the base as the spacer is moved between its forward and rearward positions, the upper wheel being engageable with a surface of the support deck and adapted to roll against the support deck as the spacer is moved between the forward and rearward positions.

16. A treadmill as set forth in claim 15 wherein the upper wheel is operatively engageable with the lower wheel in a manner such that rotation of the upper wheel in a first direction causes rotation of the lower wheel in a second direction opposite the first direction as the spacer is moved between the forward and rearward positions.

17. A treadmill as set forth in claim 15 wherein the pair of wheels constitutes a first pair of wheels, the upper wheel constitutes a first upper wheel, and the lower wheel constitutes a first lower wheel, and wherein the deck spacer further comprises a second pair of wheels, the second pair of wheels including a second upper wheel and a second lower wheel rotatable about spaced parallel axes, the second lower wheel being engageable with the base and adapted to roll against the base as the spacer is moved between its forward and rearward positions, the second upper wheel being engageable with a surface of the support deck and adapted to roll against the support deck as the spacer is moved between the forward and rearward positions.

18. A treadmill as set forth in claim 17 wherein the first upper wheel is operatively engageable with the first lower wheel in a manner such that rotation of the first upper wheel in a first direction causes rotation of the first lower wheel in a second direction opposite the first direction as the spacer is moved between the forward and rearward positions, and wherein the second upper wheel is operatively engageable with the second lower wheel in a manner such that rotation of the second upper wheel in the first direction causes rotation of the second lower wheel in the second direction as the spacer is moved between the forward and rearward positions.

19. A treadmill as set forth in claim 18 wherein the support deck includes first and second opposite side edge margins, the first upper wheel being adapted to roll against the first side edge margin as the spacer is moved between the forward and rearward positions, the second upper wheel being adapted to roll against the second side edge margin as the spacer is moved between the forward and rearward positions.

20. A treadmill as set forth in claim 14 wherein a rearward portion of the support deck is fixed relative to the base so that the support deck is cantileverly secured relative to the base.

21. A treadmill comprising:

a base;

a pair of spaced rollers journalled in the base, one of the rollers constituting a rear roller and the other roller constituting a forward roller spaced forward of the rear roller;

an endless belt entrained around the rollers, the endless belt including an upper reach extending longitudinally between the rollers and adapted to enable a user to walk or run thereon;

a longitudinally extending support deck connected to the base, the support deck being operatively engageable with an underside of the upper reach of the endless belt for supporting the upper reach;

a deck spacer including a deck engaging portion adapted for operatively engaging the support deck, the deck engaging portion being adapted to operate in at least a first condition and a second condition, the deck spacer being adapted to provide a first resistance to downward movement of the deck relative to the base when the deck engaging portion is in the first condition and to provide a second resistance to downward movement of the deck relative to the base when the deck engaging portion is in the second condition, the second resistance being different than the first resistance, the deck spacer including a rotatable member rotatably moveable relative to the base, the rotatable member being adapted for varying the deck engaging portion between its first and second conditions.

22. A treadmill as set forth in claim 21 wherein the rotatable member comprises a drive screw, the drive screw being adapted so that turning of the screw varies the deck engaging portion between its first and second conditions.

23. A treadmill as set forth in claim 22 wherein the deck spacer includes a bumper moveable between first and second positions relative to the support deck in response to varying of the deck engaging portion between its first and second conditions.

24. A treadmill as set forth in claim 23 wherein said bumper is linearly moveable between its first and second positions along an axis, said axis being generally perpendicular to the support deck.

25. A treadmill as set forth in claim 21 wherein said rotatable member includes a pulley and wherein the deck spacer includes a drive belt entrained around the pulley for driving the pulley, the pulley being fixed relative to the rotatable member so that movement of the belt is translated into rotational movement of the rotatable member.

26. A treadmill as set forth in claim 21 wherein the deck engaging portion is longitudinally moveable between forward and rearward positions relative to the support deck, the forward position corresponding to the first condition of the deck engaging portion and the rearward position corresponding to the second condition of the deck engaging portion, the rotatable member being adapted for longitudinally moving the deck engaging portion relative to the support deck between the forward and rearward positions.

27. A treadmill as set forth in claim 21 wherein a rearward portion of the support deck is fixed relative to the base so that the support deck is cantileverly secured relative to the base.

* * * * *